US006733109B1

(12) United States Patent
Lorenz et al.

(10) Patent No.: US 6,733,109 B1
(45) Date of Patent: May 11, 2004

(54) DEVICE FOR BORDERLESS PRINTING OF IMAGES USING AN INK JET PRINTER

(75) Inventors: Bernhard Lorenz, Marzling (DE); Knut Oberhardt, Foching (DE); Peter Muller, Mering (DE); Gudrun Taresch, Munich (DE)

(73) Assignee: Agfa-Gevaert Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/357,281

(22) Filed: Feb. 3, 2003

Related U.S. Application Data

(63) Continuation of application No. PCT/EP01/07515, filed on Jul. 2, 2001.

(30) Foreign Application Priority Data

Aug. 3, 2000 (DE) ..... 100 37 952

(51) Int. Cl.[7] ..... B41J 2/185
(52) U.S. Cl. ..... 347/36
(58) Field of Search ..... 347/36, 101, 104, 347/103

(56) References Cited

U.S. PATENT DOCUMENTS 5,291,227 A 3/1994 Suzuki ..... 346/140
5,717,446 A * 2/1998 Teumer et al. ..... 347/104
6,350,009 B1 * 2/2002 Freund et al. ..... 347/104
6,626,106 B2 * 9/2003 Peckham et al. ..... 101/424

FOREIGN PATENT DOCUMENTS

| | | | | |
|---|---|---|---|---|
| DE | 199 14 562 A1 | | 3/1999 | ..... B41J/29/17 |
| EP | 0 707 973 A2 | | 10/1995 | ..... B41J/13/00 |
| EP | 1 008 454 A1 | | 12/1998 | ..... B41J/11/02 |
| EP | 1040930 A2 | * | 4/2000 | ..... B41J/13/08 |
| GB | 2 220 888 | | 1/1990 | ..... B41J/13/076 |
| JP | 07009712 A | | 1/1995 | ..... B41J/11/02 |
| JP | 07025083 A | | 1/1995 | ..... B41J/11/02 |
| WO | WO 02/11990 A1 | * | 2/2002 | ..... B41J/11/16 |

OTHER PUBLICATIONS

"*Structure Paper Feed Mechanism*", IBM Technical Disclosure Bulletin, vol. 36, No. 5, May 1993, pp. 503–504.

* cited by examiner

*Primary Examiner*—Huan Tran
(74) *Attorney, Agent, or Firm*—Darby & Darby

(57) ABSTRACT

A device for borderless printing on imaging material by means of an ink jet printer has a support surface against which the imaging material lies while printing ink is applied to it during the printing process. The support surface has cutouts and is hydrophobic and/or oil-repellant, so as to repel printing ink that is sprayed outside the borders of the imaging material.

12 Claims, 2 Drawing Sheets

DEVICE FOR BORDERLESS PRINTING OF IMAGES USING AN INK JET PRINTER

CROSS-REFERENCE TO RELATED APPLICATION

This application is a Continuation of International Patent Application Serial No. PCT/EP01/07515, filed Jul. 2, 2001, which was published in German on Feb. 14, 2002 as WO 02/1190 A1.

BACKGROUND OF THE INVENTION

The invention relates to a device for borderless printing of images by means of an ink jet printer, where the image-receiving material (also referred to as imaging material) lies against a support surface during the printing process, i.e., during the phase where the printing ink is applied to the imaging material.

In principle, ink jet printers belong to the known state of the art. However, the known ink jet printers have a persistent problem in printing images of photographic quality all the way to the edge of the material without spraying ink beyond the edge. The printing ink sprayed outside the edge contaminates the support surface on which the image-receiving material is positioned, so that the ink on the support surface smears the next following piece of material.

OBJECT OF THE INVENTION

It is therefore the objective of the present invention to propose a device that allows an image to be printed all the way to the edge of the material without the aforementioned drawback of contaminating the support surface.

SUMMARY OF THE INVENTION

The present invention provides a device for borderless printing of images with an ink jet printer that has a support surface backing up the image-receiving material while printing ink is being applied to it. To meet the foregoing objective, the support surface of the device according to the invention is provided with cutouts. At least portions of the support surface are superficially hydrophobic, or the support surface consists of a hydrophobic material and/or is superficially oil-repellant or consists of an oil-repellant material, with the result that the support surface repels printing inks.

It is a particular advantage of the present invention that it is effective in preventing the contamination of the support surface, because the support surface is repellant to printing ink, so that the latter can no longer adhere to the support surface. Furthermore, the support surface has cutouts through which a major portion of the ink escapes directly, without coming into contact with the support surface. This is conducive to a better quality of the printed materials and fewer rejects.

The invention can be advantageously employed in ink jet printers that work with rollers, belts, or print stages.

According to an advantageous embodiment of the invention, the support surface is superficially hydrophobic, e.g., by having a hydrophobic coating, or the support surface itself consists of a hydrophobic material. This embodiment of the invention has the advantage that the printing ink cannot adhere to the support surface and is therefore easy to remove if the ink is water-based. If the ink is oil-based, it would be advantageous for the support surface to be oil-repellant.

The aforementioned cutouts are advantageously made large enough so that the ink that is sprayed outside the edge of the imaging material falls directly into the cutouts instead of on the support surface. It is advantageous if the cutouts surround the entire sheet that is being printed. In this case, the ink does not even have an opportunity to adhere to the support surface but escapes directly through the cutouts.

It is particularly advantageous if the cutouts are configured as slots that are appropriately arranged for the different formats of the imaging material, so that the edges of the imaging material lie on the slots. With this design concept for the support surface, if ink is sprayed outside the edge of the imaging material, it can run off directly through the slots, so that a contamination of the support surface is prevented.

To facilitate the disposal of the ink escaping though the slots, a further developed preferred embodiment of the invention has a vacuuming-, cleaning- or rinsing device arranged at the slots.

The slots in the support surface can also be designed in such a manner that the entire support surface forms a grate. This has the particular advantage that only a very small part of the printing ink falls on the grate and that the edges of the imaging material do not have to be positioned exactly over the slots. Most of the over-sprayed ink falls directly to a level below the grate, from which it can be carried away.

As an advantageous further development of the invention, if the grate has a hydrophobic or oil-repellant surface or is made of a hydrophobic or oil-repellant material, it will be particularly effective in avoiding the contamination of the support surface.

To ensure the safe capture and disposal of the printing ink falling through the grate, a preferred embodiment of the invention is equipped with a collecting and catching device to carry the ink away.

The vacuum device for removing the printing ink can simultaneously be used to provide suction for holding the imaging material in place on the support surface, so that a separate suction-generating device can be omitted.

To hold the imaging material in place, the support surface has small suction holes in addition to the cutouts, with the cutouts being larger than the suction holes.

To ensure a fast and easy removal of the printing ink from the ink-repellant surface, a preferred embodiment of the invention has an ink-removing device arranged at the support surface. The ink-removing device or cleaning device can be designed to be moved over the support surface, for example a roller with absorbent material such as fleece. It can also be advantageous if the support surface is moved along a cleaning device, especially in embodiments that use a movable support surface for the printing process. The cleaning device is preferably configured as a vacuuming-, wiping-, or similar device.

The vacuuming or wiping device advantageously consists of a washing bath at the underside of the roller or the belt and could be supplemented by a wiper or a cleaning roller. Thus, ink residues on the support surface can be removed in a simple manner without the need to use expensive techniques.

BRIEF DESCRIPTION OF THE DRAWINGS

Further distinctive traits and advantages of the invention will be discussed in the following description of embodiments that are illustrated in the drawings, wherein.

DETAILED DESCRIPTION OF PREFERRED EMBODIMENTS

Figure 1:
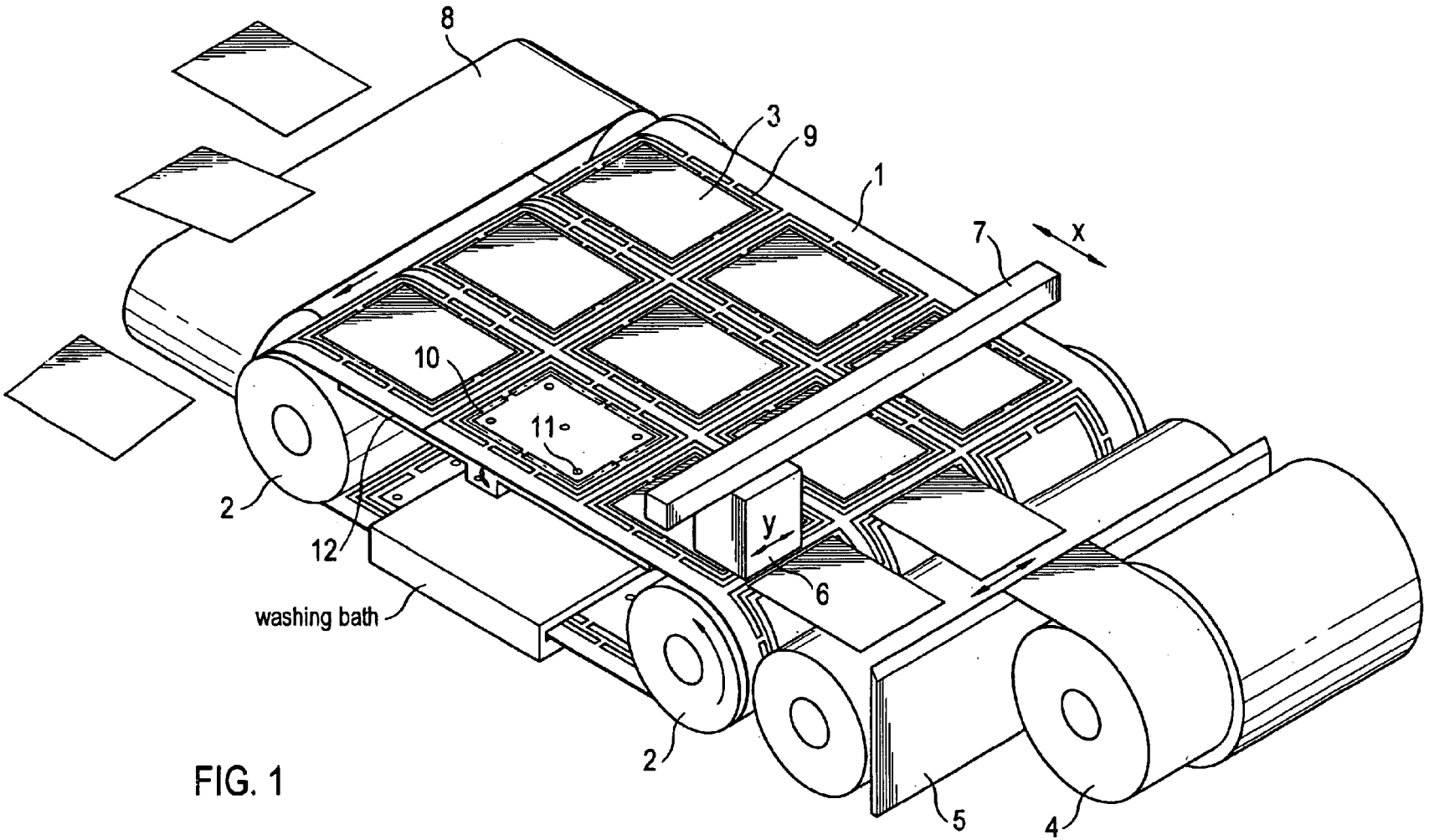
FIG. 1 represents an ink jet printer with a support surface in accordance with the invention.

FIG. 1 shows an ink jet printer with a support surface configured in accordance with the invention. The support surface 1 is in this case a suction-assisted and hydrophobically repellent conveyor belt running around a pair of rollers 2. Several rows of image-receiving material 3 can be seen lying on the support surface 1.

The imaging material 3 is pulled off a continuous paper roll 4 and cut to the desired length by a knife 5, whereupon the cut sheets are placed by a sheet-handling device (not shown) into the desired number of rows on the support surface 1.

Arranged above the support surface 1 is an ink jet print head 6 running on a guide rail 7 that extends over the entire width of the carrier surface 1. Thus, the ink jet print head 6 is movable back and forth in the y-direction, i.e., transverse to the direction in which the imaging material 3 advances on the conveyor belt. The guide rail 7 is movable back and forth in the x-direction, i.e., in the same direction as the image-receiving material 3 moves on the conveyor belt.

After the support surface 1, there can be a sorter 8 to sort the sheets of the imaging material 3 after the printing phase.

According to the invention, the support surface 1 has slots 9 in the form of cutouts in the conveyor belt. The slots 9 are configured and arranged in such a way that they run along the border 10 of the imaging material 3, which is indicated by a broken line. Different slots 9 are provided for different sheet formats of the imaging material 3.

After the imaging material 3 has been distributed by the sheet-handling device on the support surface 1, it is held firmly in position by means of the suction holes 11 in the suction-assisted conveyor belt. The positioning arrangement for the image-receiving material on the belt is such that the edges of the sheets are placed exactly over the cut-out slots 9. When the print head 6 prints on the material 3, the ink that is sprayed beyond the sheet edges of the material 3 falls into the slots 9 where it is suctioned off by the suction device 12 which also serves to provide the holding suction for the sheets. Due to the hydrophobic properties of the suctionassisted conveyor belt, the suction also pulls ink into the slots 9 that has fallen on the borders of the slots or on the narrow connecting portions interrupting the slots. Thus, due to the combined effect of the cutouts swallowing most of the over-sprayed ink immediately and the hydrophobic property preventing the ink from sticking to the carrier surface 1, all of the ink that is sprayed on the carrier surface 1 in the printing process is suctioned off by the suction device 12.

Figure 2:
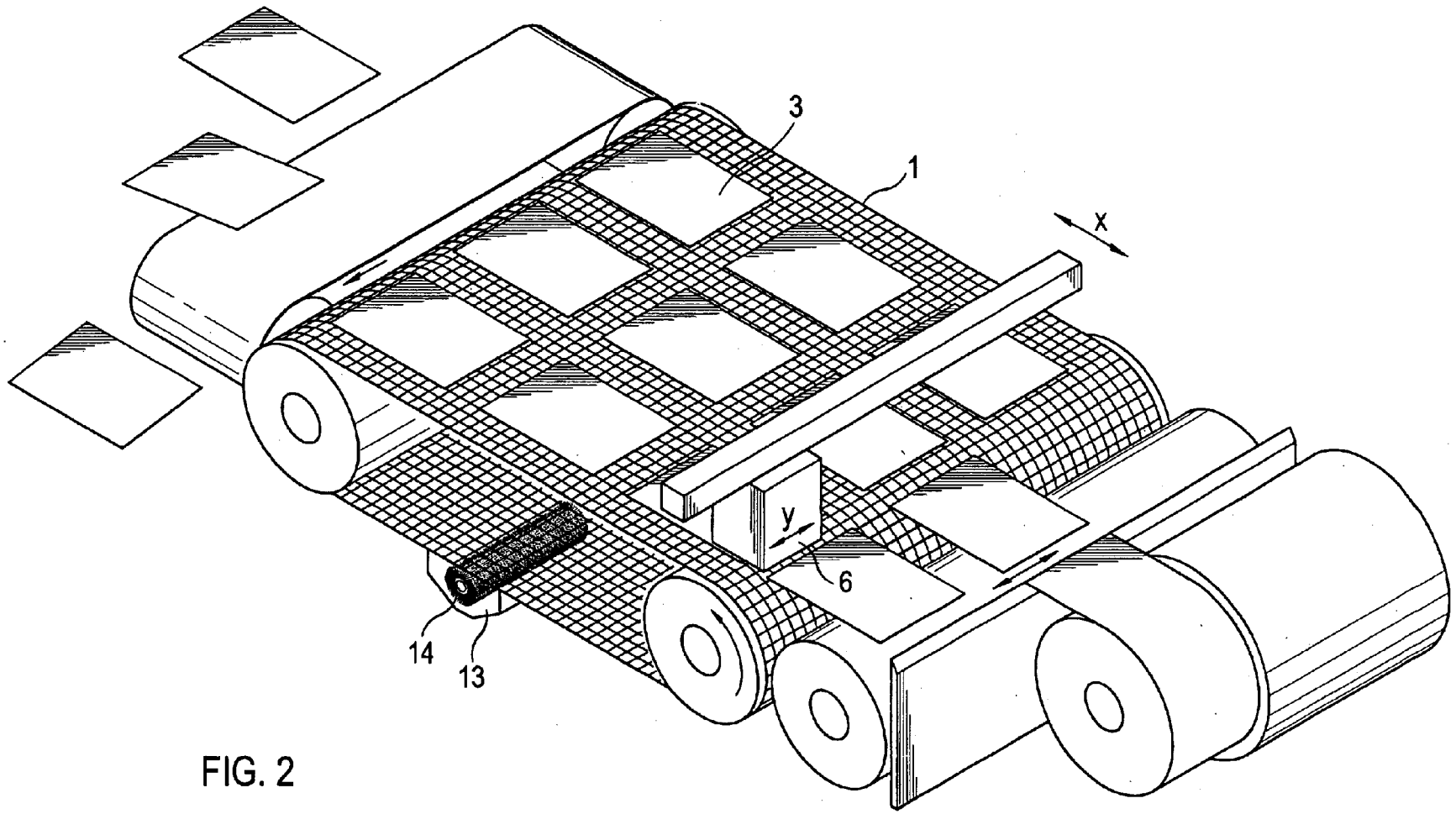
FIG. 2 represents an ink jet printer with a further embodiment of a support surface in accordance with the invention.

FIG. 2 illustrates an alternative configuration of the carrier surface 1 in accordance with the invention. In this case, the carrier surface has the shape of a grate. Depending on the kind of ink being used, the surface of the grate consists of either a hydrophobic material or an oil-repellant material. The ink that is sprayed outside the edges of the imaging material 3 by the print head 6 falls through the grate into a catch basin or a suction device. The ink remaining on the grate is wiped off as the belt moves over a moistened roller 14 of a cleaning device 13 that is located at the part of the belt loop on the opposite side from the printing area.

What is claimed is:

1. A device for borderless printing on imaging material by means of an ink jet printer, comprising a support surface against which the imaging material lies while printing ink is applied to the imaging material during a printing process, wherein the imaging material is delimited by edges and wherein over-sprayed ink misses the imaging material and falls outside said edges, wherein said support surface is provided with cutouts configured as material-free passage opening, through which a major portion of the over-sprayed ink escapes directly without coming into contact with the support surface, and wherein said support surface comprises at least one of an at least partially hydrophobic surface, a hydrophobic material, an oil-repellant surface, and an oil-repellant material, whereby the support surface is made repellant to the over-sprayed ink.

2. The device of claim 1, wherein the imaging material is provided in different format sizes, and wherein the cutouts are configured as slots and are arranged so that for each of the different format sizes each of the edges will be aligned with and partially overhang one of the slots.

3. The device of claim 2, wherein at least one of a vacuuming device, a cleaning device and a rinsing device is arranged at the slots.

4. The device of claim 1, wherein the support surface is configured as a grate.

5. The device of claim 4, wherein the grate comprises one of a hydrophobic surface and a hydrophobic material.

6. The device of claim 4, wherein the grate comprises one of an oil-repellant surface and an oil-repellant material.

7. The device of claim 4, wherein a device for catching, collecting and removing the over-sprayed ink is arranged below the grate.

8. The device of claim 1, comprising a cleaning device for removing printing the over-sprayed ink from the support surface.

9. The device of claim 8, wherein the support surface is stationary and the cleaning device moves over the support surface.

10. The device of claim 8, wherein the cleaning device is stationary and the support surface moves over the cleaning device.

11. The device of claim 9, wherein the cleaning device comprises at least one of a vacuuming device and a wiping device.

12. The device of claim 10, wherein the cleaning device consists of a washing bath.

* * * * *